US011382806B2

(12) United States Patent
Davis

(10) Patent No.: US 11,382,806 B2
(45) Date of Patent: Jul. 12, 2022

(54) INFLATABLE MATTRESS WITH LATERAL EXTENSIONS

(71) Applicant: D.T. DAVID ENTERPRISES, LTD., Allentown, PA (US)

(72) Inventor: David T. Davis, Bethlehem, PA (US)

(73) Assignee: D.T. Davis Enterprises, Ltd., Allentown, PA (US)

( * ) Notice: Subject to any disclaimer, the term of this patent is extended or adjusted under 35 U.S.C. 154(b) by 0 days.

(21) Appl. No.: 16/981,878

(22) PCT Filed: May 29, 2019

(86) PCT No.: PCT/US2019/034300

§ 371 (c)(1),
(2) Date: Sep. 17, 2020

(87) PCT Pub. No.: WO2019/231987

PCT Pub. Date: Dec. 5, 2019

(65) Prior Publication Data

US 2021/0093493 A1 Apr. 1, 2021

Related U.S. Application Data

(60) Provisional application No. 62/678,445, filed on May 31, 2018.

(51) Int. Cl.
*A61G 1/048* (2006.01)
*A47C 27/08* (2006.01)

(52) U.S. Cl.
CPC ..... *A61G 1/048* (2013.01); *A47C 27/081* (2013.01); *A47C 27/08* (2013.01)

(58) Field of Classification Search
CPC ..... A61G 1/048; A61G 1/04; A47C 27/081; A47C 27/08

(Continued)

(56) References Cited

U.S. PATENT DOCUMENTS 2,886,834 A 5/1959 Gilbertson
7,340,785 B2 * 3/2008 Weedling ..... A61G 7/1028 5/706

(Continued)

FOREIGN PATENT DOCUMENTS

WO 2015/081271 6/2015
WO WO-2019231987 A1 * 12/2019 ..... A47C 27/081

OTHER PUBLICATIONS

International Search Report and Written Opinion dated Aug. 2, 2019 for corresponding PCT Application No. PCT/US2019/034300.

(Continued)

*Primary Examiner* — Robert G Santos
(74) *Attorney, Agent, or Firm* — Duane Morris LLP

(57) ABSTRACT

In one aspect, an inflatable patient handling mattress includes a mattress body, a first lateral extension, a second lateral extension, and one or more lift handles. The mattress body includes a top panel, a bottom panel, and a plenum chamber between the top panel and the bottom panel and configured to be filled with air. The first lateral extension extends from a first side of the mattress body. The second lateral extension extends from a second side of the mattress body, the second side opposite the first side. Each lift handle of the one or more lift handles is attached to one of the first lateral extension and the second lateral extension. The one or more lift handles are configured to be used to lift a patient disposed on the mattress body.

16 Claims, 5 Drawing Sheets

(58) Field of Classification Search
USPC ..... 5/625, 706, 644, 654, 655.3
See application file for complete search history.

(56) References Cited

U.S. PATENT DOCUMENTS

| | | | | |
|---|---|---|---|---|
| 7,415,738 | B2 * | 8/2008 | Weedling | A61G 7/103 5/710 |
| 7,591,029 | B2 * | 9/2009 | Weedling | A61G 7/103 5/655.3 |
| 7,739,758 | B2 * | 6/2010 | Weedling | A61G 7/103 5/81.1 R |
| 7,900,299 | B2 * | 3/2011 | Weedling | A61G 7/1051 5/81.1 R |
| 8,234,727 | B2 | 8/2012 | Schreiber et al. | |
| 8,566,977 | B2 * | 10/2013 | Davis | A61G 7/1028 5/81.1 HS |
| 9,241,580 | B2 * | 1/2016 | Patrick | A61G 7/1028 |
| 9,504,621 | B2 * | 11/2016 | Purdy | A61G 7/001 |
| 9,693,919 | B2 * | 7/2017 | Berman | A61G 7/1023 |
| 9,756,955 | B2 | 9/2017 | Alder et al. | |
| 9,833,371 | B2 * | 12/2017 | Purdy | A61G 7/05792 |
| 10,039,680 | B2 * | 8/2018 | Galbraith | A61G 7/1073 |
| 10,117,800 | B1 * | 11/2018 | Galbraith | A61G 7/1051 |
| 10,363,185 | B2 * | 7/2019 | Purdy | A61G 7/057 |
| 10,596,051 | B2 * | 3/2020 | Purdy | A61G 7/001 |
| 10,772,778 | B2 * | 9/2020 | Hahn | A61G 7/05715 |
| 10,925,790 | B2 * | 2/2021 | Rodzewicz | A61G 7/1023 |
| 2002/0166168 | A1 * | 11/2002 | Weedling | A61G 7/103 5/81.1 R |
| 2005/0028273 | A1 * | 2/2005 | Weedling | A61G 7/1051 5/81.1 R |
| 2005/0034229 | A1 * | 2/2005 | Weedling | A61G 7/103 5/81.1 R |
| 2005/0034230 | A1 * | 2/2005 | Weedling | A61G 7/1096 5/81.1 R |
| 2005/0102749 | A1 | 5/2005 | Heimbrock | |
| 2006/0000016 | A1 * | 1/2006 | Weedling | A61G 7/1028 5/81.1 HS |
| 2006/0253976 | A1 * | 11/2006 | Weedling | A61G 7/1051 5/81.1 R |
| 2008/0209630 | A1 * | 9/2008 | Kazala | A61G 7/1026 5/81.1 T |
| 2010/0229298 | A1 | 9/2010 | Davis | |
| 2012/0210511 | A1 * | 8/2012 | Davis | A61G 7/1051 5/81.1 R |
| 2012/0311781 | A1 * | 12/2012 | Purdy | A61G 7/05792 5/81.1 T |
| 2013/0198950 | A1 * | 8/2013 | Purdy | A61G 7/1021 5/81.1 T |
| 2014/0041114 | A1 * | 2/2014 | Davis | A61G 7/1025 5/83.1 |
| 2014/0082836 | A1 * | 3/2014 | Patrick | A61G 1/02 5/81.1 HS |
| 2016/0067126 | A1 * | 3/2016 | Purdy | A61G 7/05753 5/655.3 |
| 2016/0095777 | A1 * | 4/2016 | Berman | A61G 7/1023 5/81.1 T |
| 2016/0374883 | A1 * | 12/2016 | Galbraith | A61G 7/1051 5/81.1 T |
| 2018/0028381 | A1 * | 2/2018 | Purdy | A61G 7/1023 |
| 2018/0303690 | A1 * | 10/2018 | Hahn | A61G 7/1055 |
| 2018/0311097 | A1 * | 11/2018 | Rodzewicz | A61G 7/1025 |
| 2018/0318162 | A1 * | 11/2018 | Galbraith | A61G 7/1055 |
| 2021/0093493 | A1 * | 4/2021 | Davis | A61G 1/048 |

OTHER PUBLICATIONS

European Patent Office, Extended European Search Report issued in corresponding European Patent Application No. 19812315.0 dated Feb. 11, 2022.

* cited by examiner

INFLATABLE MATTRESS WITH LATERAL EXTENSIONS

BACKGROUND

Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the increased volume of air acts initially to jack a load placed upon the mattress above the perforated flexible sheet, and the escape of air under pressure through the pinholes creates an air bearing of relatively small height between the underlying fixed, generally planar support surface and the perforated flexible sheet. In applications in which the mattress allows for lifting of the mattress and patient, the width of the plenum chamber is often increased to allow easier handling of the mattress.

SUMMARY

In one aspect, an inflatable patient handling mattress includes a mattress body, a first lateral extension, a second lateral extension, and one or more lift handles. The mattress body includes a top panel, a bottom panel, and a plenum chamber between the top panel and the bottom panel and configured to be filled with air. The first lateral extension extends from a first side of the mattress body. The second lateral extension extends from a second side of the mattress body, the second side opposite the first side. Each lift handle of the one or more lift handles is attached to one of the first lateral extension and the second lateral extension. The one or more lift handles are configured to be used to lift a patient disposed on the mattress body.

In another aspect, an inflatable patient handling mattress includes a mattress body, a lateral extension, and one or more lift handles attached to the lateral extension. The mattress body includes a top panel, a bottom panel, and a plenum chamber between the top panel and the bottom panel and configured to be filled with air. The lateral extension extends from a first side of the mattress body. The one or more lift handles are configured to be used to lift a patient disposed on the mattress body.

In another aspect, a method includes positioning a patient on an inflatable patient handling mattress. The inflatable patient handling mattress includes a mattress body, a lateral extension, and one or more lift handles attached to the lateral extension. The mattress body includes a top panel, a bottom panel, and a plenum chamber between the top panel and the bottom panel and configured to be filled with air. The lateral extension extends from a first side of the mattress body. The method further includes lifting upward on at least one of the one or more lift handles to lift the patient.

BRIEF DESCRIPTION OF THE DRAWINGS

The features and advantages of the present invention will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
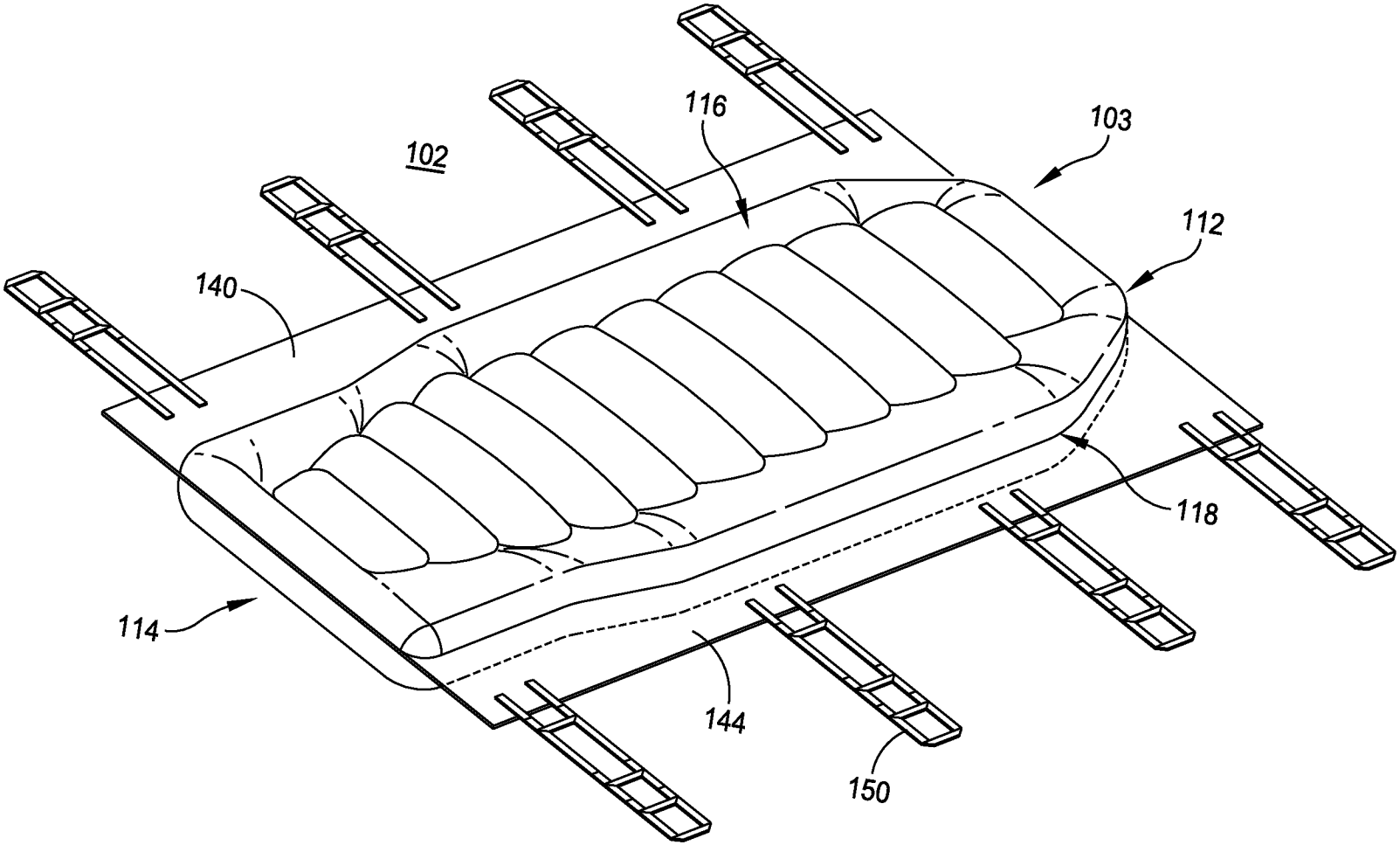
FIG. 1 is a top perspective view of an inflatable mattress having lateral extensions, according to one embodiment.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise. The term "operatively coupled" is such an attachment, coupling, or connection that allows the pertinent structures to operate as intended by virtue of that relationship. In the claims, means-plus-function clauses, if used, are intended to cover structures described, suggested, or rendered obvious by the written description or drawings for performing the recited function, including not only structure equivalents but also equivalent structures.

The present description is related to inflatable mattresses that include a mattress body defining a plenum and a lateral extension extending from at least one side of the mattress body. The lateral extension makes it easier to move and/or lift a patient disposed on the mattress body, as will be described herein.

Figure 2:
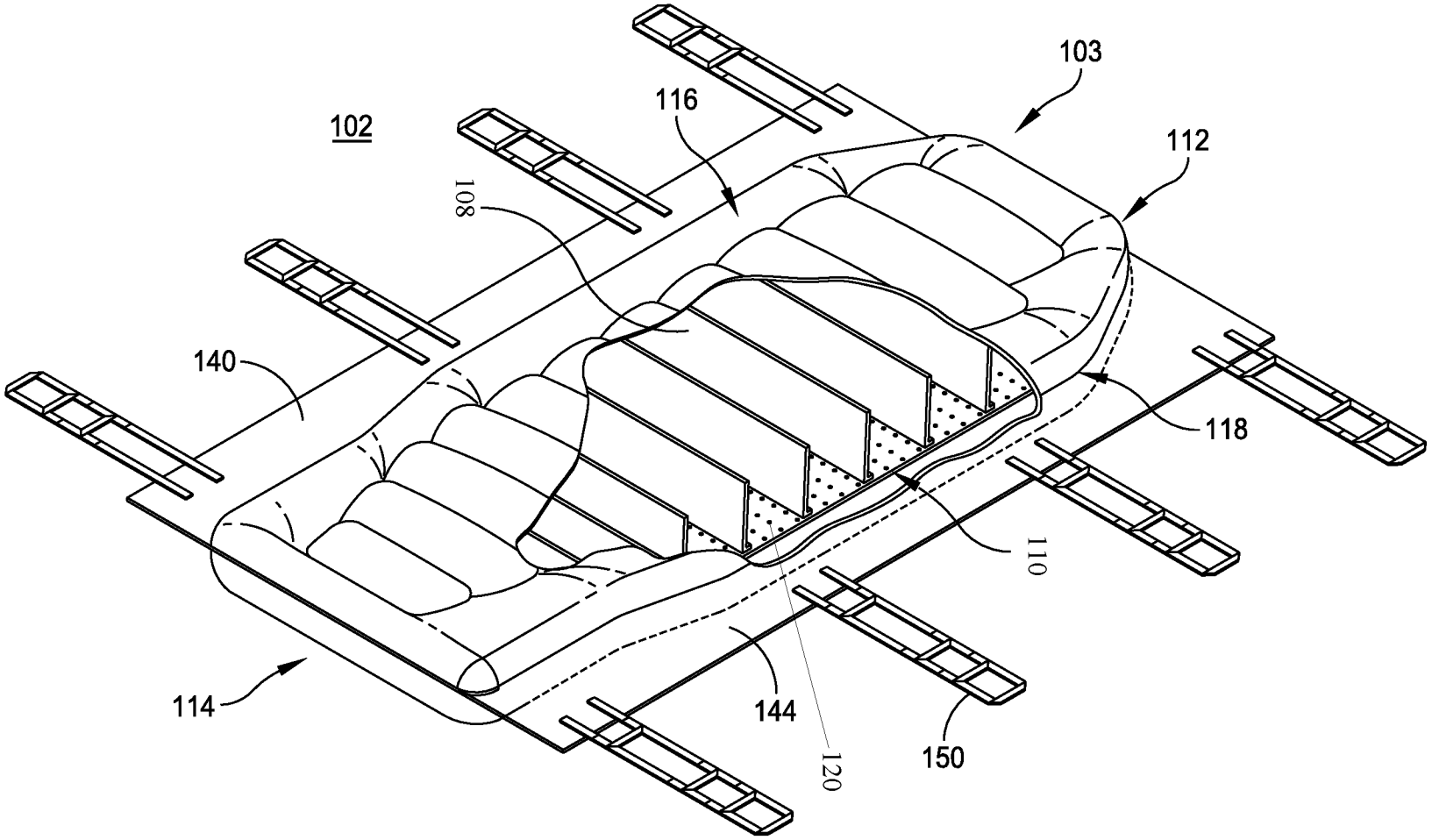
FIG. 2 is a partial cut-away view of the inflatable mattress of FIG. 1.
Figure 3:
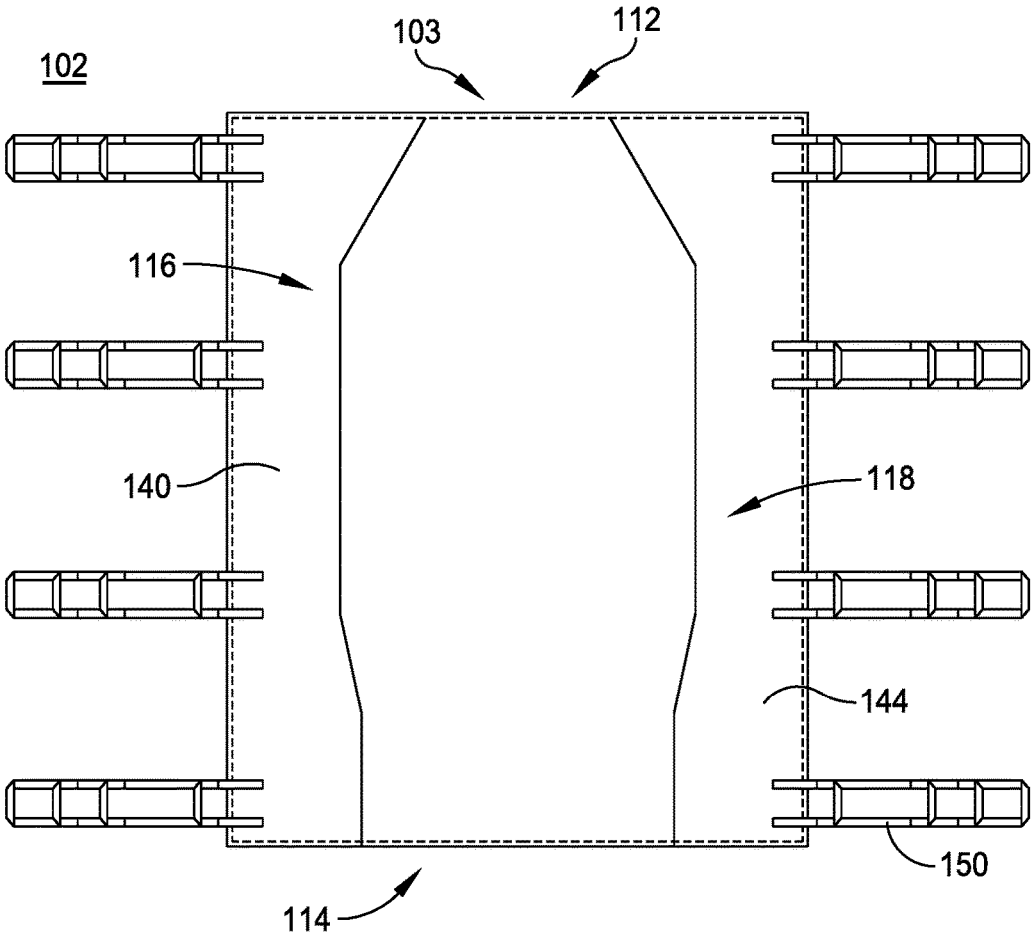
FIG. 3 is a top view of the inflatable mattress of FIG. 1.
Figure 4:
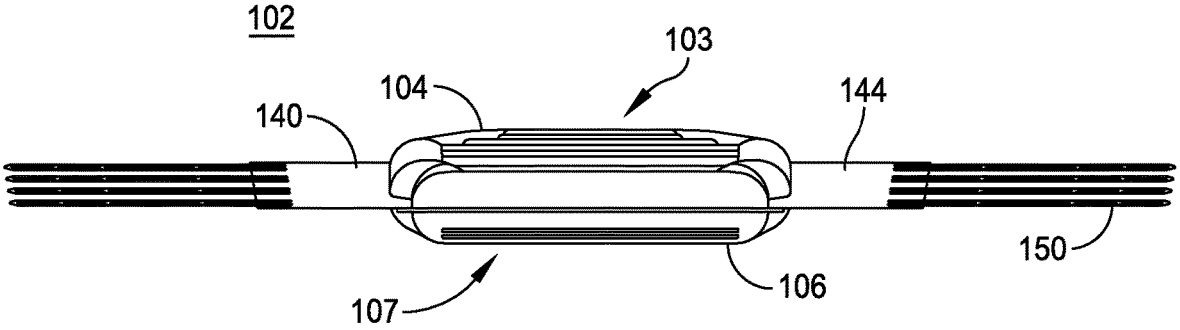
FIG. 4 is an end perspective view of the inflatable mattress of FIG. 1.
Figure 5:
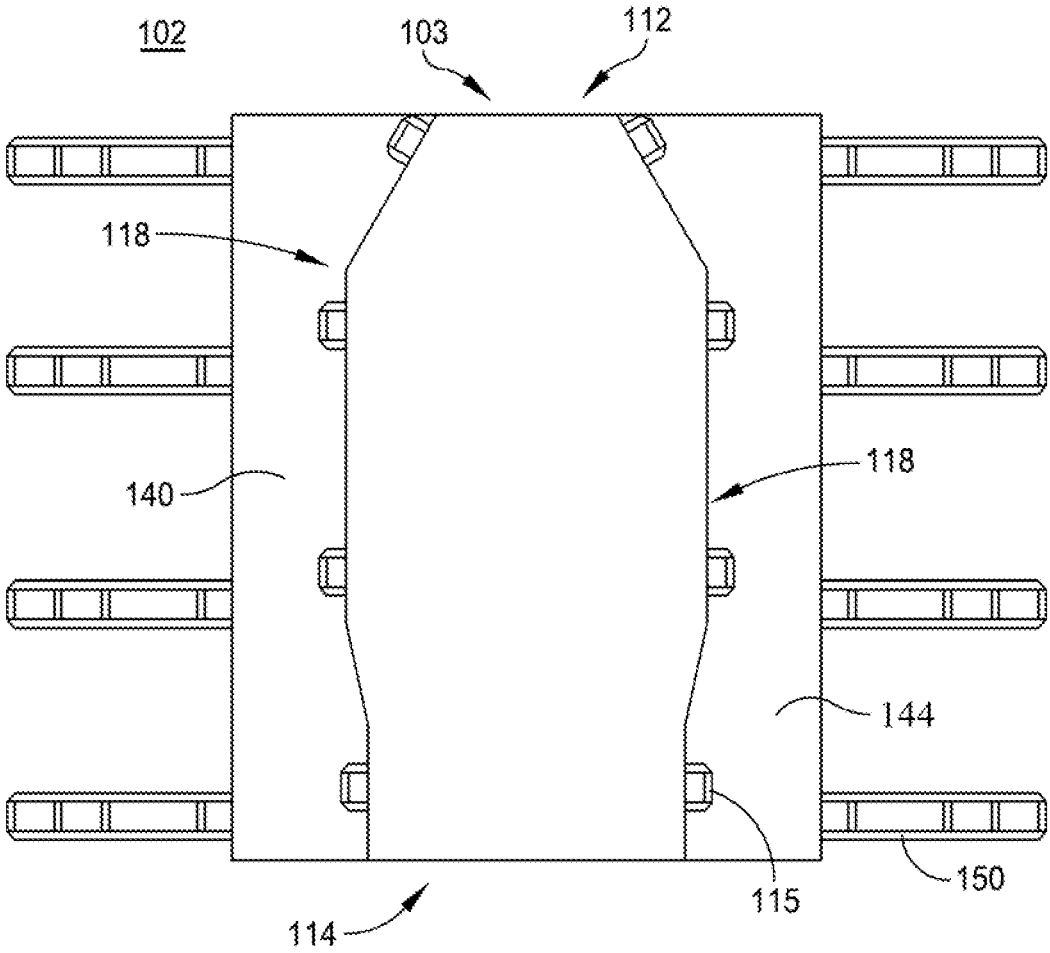
FIG. 5 is a bottom view of the inflatable mattress of FIG. 1.

FIGS. 1-4 show an embodiment of an inflatable mattress 102. Inflatable mattress 102 includes a mattress body 103 including a top panel 104, a bottom panel 106, and a plurality of stringers 108 interior to a plenum chamber 110 (shown in FIG. 2) formed by the top panel 104 and the bottom panel 106 and extending from the top panel 104 to the bottom panel 106. More particularly, as shown in FIGS. 1-3, the inflatable mattress 102 comprises a proximal end 112, a distal end 114, a first side 116 and an opposite second side 118 extending between the proximal end 112 and the distal end 114. An inlet opening (not shown) is formed in the inflatable mattress 102, and may be a closable opening that sealingly accepts an air supply hose. The inlet opening is sized and shaped so that the air supply hose may be inserted, with the inlet being thereafter snapped shut or otherwise closed to hold the air supply hose in place while the inflatable mattress is being inflated. The inlet opening may also include a valve (not shown) that is biased to be normally closed to prevent air from exiting through the inlet, and opened when an air supply hose is inserted into the inlet opening. Other arrangements known to those skilled in the art may be used to inflate inflatable mattress 102. The inflatable mattress 102 can also include a plurality of handles 115 (shown in FIG. 5) to allow for easy handling and movement of the inflatable mattress.

The top panel 104 and the bottom panel 106 are engaged along their peripheral edges. The top panel 104 and bottom panel 106 can be directly engaged, for example by radiofrequency welding, adhesives, weldable hook fasteners, sewing, heat sealing, ultrasonic welding, or the like. Alternatively, in some embodiments, a perimeter band (not shown) is coupled between the top panel 104 and the bottom panel 106.

Bottom panel 106 also includes a plurality of apertures 120 (shown in FIG. 2) that are defined through its thickness to allow air, that is supplied by a low-pressure air supply to inflatable mattress 102, via the air supply hose, to escape in a controlled manner. The air supplied to inflatable mattress 102 escapes through the plurality of apertures, providing a weight-bearing cushion of air that facilitates the sliding of inflatable mattress 102 along a surface, as well as from one surface to another.

It should be understood that some or all of the top panel 104, the bottom panel 106, the perimeter band, and the stringers are most often, but not always, formed from a sheet of fabric, e.g., nylon scrim or the like, and may be coated on at least the outer surface with an air impermeable coating. One or more surfaces can also be coated with a water proof coating. The water proof coating may be any of the well-known polymeric or elastomeric compounds that are known to be impervious to semi-solids and liquids, such as, blood, urine, feces, hospital strength disinfecting compounds, alcohol, or the like. For example, a nylon twill fabric that is coated on one side with a heat sealable, polyurethane coating (e.g., an inner side) and the outer side coated with a Durable Water Repellant (patient side). A practical benefit associated with the use of the foregoing preferred materials is that the inflatable mattress 102 retains a better appearance for longer periods of time during use. A double coated inflatable mattress 102 can be easily wiped down, and can be put back into use more quickly.

Alternatively, in those instances where a single use, single patient mattress is provided, i.e., where patient use lasting less than twenty-four hours is desired, some or all of the top panel 104, the bottom panel 106, the perimeter band, and the stringers may be formed from fibers for forming fabrics suitable for single use. For example, the top panel 104 may be made of materials, such as, acetate, acrylic, anidex, aramid, azlon, cotton, elastoester, fluorocarbon, fur, glass, lyocell, melamine, metallic, modacrylic, modal, mosacrylic, novoloid, nylon, nytril, olefin, PAN, PBI, PEEK, Pelco, PEN, PLA, PTT, polyester, polyester-polyarylate, rayon, saran, spandex, sulfar, triacetate, vinal, vinyon, and wool. A common characteristic of the foregoing and like materials is their propensity to stain or discolor as a result of contact with blood, urine, feces, hospital strength disinfecting compounds, alcohol, or the like. Additionally, a variety of films may be used to form a single patient, single use inflatable mattress 102, for example, copolyester, copolyether, ethylene vinyl acetate, fluorocarbon, polyamide, olefins, polybutylene, polycarbonate, polyester, polystyrene, polyurethane, polyvinyl, alcohol, polyvinyl chloride, polyvinyl fluoride, and polyvinylidene chloride. A practical benefit associated with the use of the foregoing preferred materials is that such an inflatable mattress 102 retains a stained and discolored appearance for longer periods of time after use, thereby alerting hospital staff or other care givers that a particular inflatable mattress 102 has completed its useful life, and must be discarded.

In one embodiment, some or all of the top panel 104, the bottom panel 106, the perimeter band and the stringers may comprise a cold water soluble partially hydrolyzed polyvinyl alcohol, cold water insoluble hot water disintegrable aliphatic polyester, and minor proportions of processing and performance aids. The aliphatic polyester has a melt temperature above the normal body temperature of a human (approximately 37 degrees C. or 98.6 degrees F.) and is present in the resin blend at a concentration sufficient to constitute the continuous phase of the blend, with the polyvinyl alcohol constituting a discontinuous phase of the blend. The aliphatic polyester renders the resin blend, and the partially hydrolyzed polyvinyl alcohol in the blend is, cold water insoluble and determines the temperature at which articles formed from the blend will be subject to dissolution in an aqueous bath and subsequent disposal. A practical benefit associated with the use of the foregoing material is that such an inflatable mattress 102 not only retains a stained and discolored appearance for longer periods of time after use, thereby alerting hospital staff or other care givers that a particular inflatable mattress 102 has completed its useful life, and must be discarded, but also if an attempt is made to launder the mattress after a single use it disintegrates during the washing process.

As shown in FIGS. 1-5, the inflatable mattress 102 further includes a first lateral extension 140 extending from the first side 116 and a second lateral extension 144 extending from the second side 118. The lateral extensions 140, 144 can be formed of any appropriate material. For example, the lateral extensions 140, 144 can be formed from the same material as the top panel 104. In one embodiment, the lateral extensions 140, 144 include a non-woven polyester. The lateral extensions 140, 144 can be attached to the mattress body 103 in any appropriate manner. For example, in one embodiment, the lateral extensions 140, 144 are sewn between the top panel 104 and the bottom panel 106. In another embodiment, the lateral extensions 140, 144 are attached to a perimeter band extending between the top panel 104 and the bottom panel 106, for example by RF welding, ultrasonic welding, or bonding. In one embodiment, the lateral extensions 140, 144 are attached to the stringers. In another embodiment, the lateral extensions 140, 144 are integrally formed with the top panel 104 or the bottom panel 106. For example, the top panel 104 may be wider than the bottom panel 106 such that when the top panel 104 and bottom panel 106 are joined, the lateral extensions 140, 144 extend past the perimeter of the mattress body 103.

In one embodiment, the first lateral extension 140 and the second lateral extension 144 are portions of a single sheet of material. The sheet can be positioned between the top panel 104 and the bottom panel 106 prior to joining the top panel to the bottom panel, thereby forming a sandwich structure. The single sheet of material can have a window corresponding to the plenum chamber, thereby allowing stringers to extend from the top panel 104 to the bottom panel 106 as well as allowing the flow of air throughout the plenum formed by the top panel 104 and bottom panel 106. By configuring the extensions in this way, positioning and affixing the lateral extensions 140, 144 to the top panel 104 and/or bottom panel 106 may be simpler and more efficient.

In addition, a plurality of lift handles 150 are attached to the lateral extensions 140, 144. The lift handles allow for lifting of the patient positioned on the mattress body 103. The lift handles 150 can include a plurality of grip positions, as shown in FIGS. 1-7. As such, the handles 150 have multiple locations for the user to grasp to provide a more comfortable and ergonomic grasp of the mattress. Alternatively, an overhead lift or crane, such as a motorized lift, can be attached to the lift handles 150 at a variety of positions. Any number of lift handles 150 can be attached to each lateral extension. For example, in one embodiment, four lift handles 150 are attached to each lateral extension.

Figure 6:
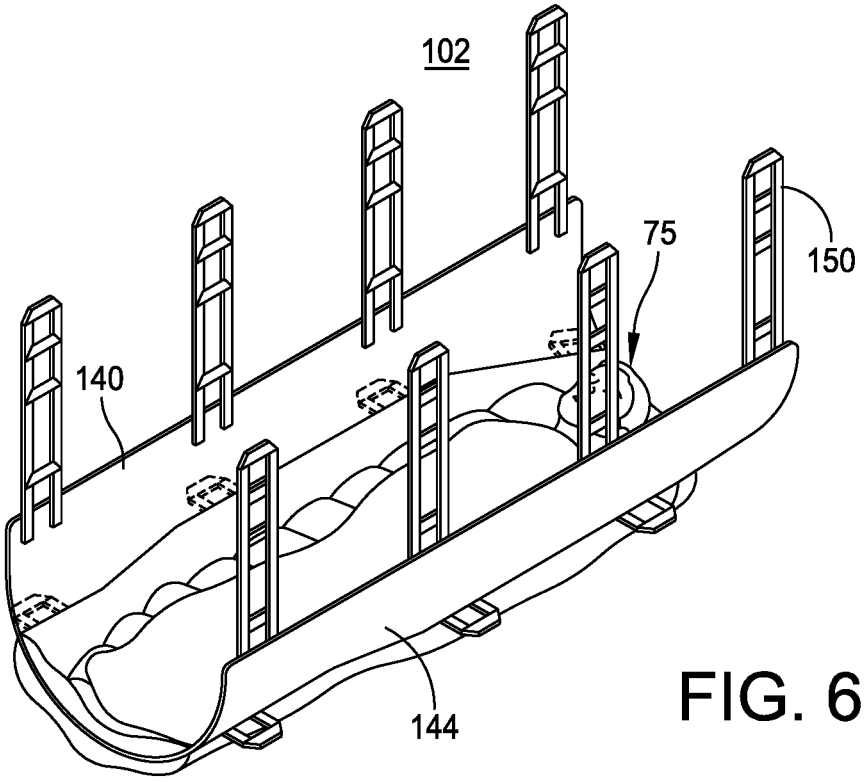
FIG. 6 is a perspective view of the inflatable mattress of FIG. 1 in a lift configuration.

As shown in FIG. 6, when it is desired to lift a patient, the caregivers or a mechanical lift can lift upward on the lift handles 150. In response, the lateral extensions 140, 144 fold upward. This provides a cradling effect that helps to ensure that the patient remains securely positioned.

Figure 7:
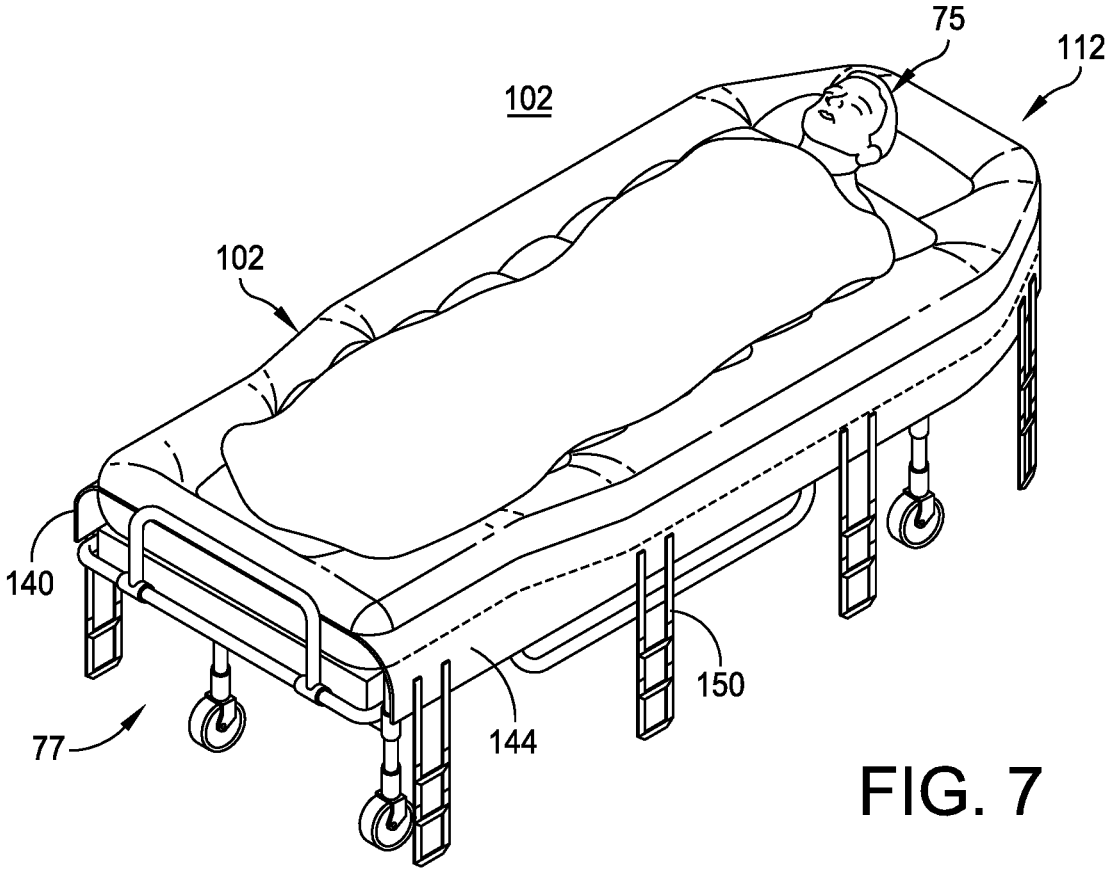
FIG. 7 is a perspective view of the inflatable mattress of FIG. 1 with a patient disposed thereon.

After the inflatable mattress 102 is in the desired position, and lifting is no longer necessary, the lateral extensions 140, 144 can be allowed to drape on the side of a hospital bed, operating table, stretcher or other platform supporting the inflatable mattress 102, as shown in FIG. 7. This can be done in a more easily controlled manner than deflating a significantly wider mattress. Hence, the excess material does not bunch beneath the patient.

Because the lateral extensions 140, 144 provide extra width and material for lifting the patient, without increasing the size of the mattress body 103 or the plenum chamber 110, a number of advantages are provided. For example, the volume of air required to inflate the mattress is decreased, thereby reducing the time for inflation. In addition, when positioning a patient on a relatively narrow stretcher or other support, it easier for the caregiver to center the patient on the stretcher or support than it would be if the width of the mattress body were increased. In one embodiment, the deflated width of the mattress body 103 is about 34 inches and the lateral extensions 140, 144 are each about 4 inches to 5 inches wide. In another embodiment, the lateral extensions 140, 144 are each at least 4 inches wide. In another embodiment, the lateral extensions 140, 144 are each at least 3 inches wide. In another embodiment, the lateral extensions 140, 144 are each between about 3 inches and about 6 inches wide.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention. All patents and published patent applications identified herein are incorporated herein by reference in their entireties.

The invention claimed is:

1. An inflatable patient handling mattress comprising:
- a mattress body including:
  - a top panel;
  - a bottom panel; and
  - a plenum chamber between the top panel and the bottom panel configured to be filled with air;
- a first lateral extension extending from a first side of the mattress body;
- a second lateral extension extending from a second side of the mattress body, the second side opposite the first side, wherein the first lateral extension and the second lateral extension are portions of a single sheet of material positioned between the top panel and the bottom panel, wherein the single sheet of material defines a window corresponding to the plenum chamber between the top panel and the bottom panel; and
- one or more lift handles, each lift handle of the one or more lift handles attached to one of the first lateral extension and the second lateral extension;
- wherein the one or more lift handles are configured to be used to lift a patient disposed on the mattress body.

2. The inflatable patient handling mattress of claim 1, wherein the mattress body further comprises a perimeter band between the top panel and the bottom panel.

3. The inflatable patient handling mattress of claim 1, wherein the first lateral extension and the second lateral extension comprise a non-woven polyester material.

4. The inflatable patient handling mattress of claim 1, wherein the one or more lift handles each include a plurality of grip locations.

5. The inflatable patient handling mattress of claim 1, wherein the first lateral extension defines a first width from the first side of the mattress body to an outer edge of the first lateral extension, and wherein the first width is between about 3 inches and about 6 inches.

6. The inflatable patient handling mattress of claim 5, wherein the second lateral extension defines a second width from the second side of the mattress body to an outer edge of the second lateral extension, and wherein the second width is between about 3 inches and about 6 inches.

7. An inflatable patient handling mattress comprising:
- a mattress body including:
  - a top panel;
  - a bottom panel; and
  - a plenum chamber between the top panel and the bottom panel configured to be filled with air;
- a lateral extension extending from a first side of the mattress body, wherein the lateral extension is a portion of a material positioned between the top panel and the bottom panel, wherein the material defines a window corresponding to the plenum chamber between the top panel and the bottom panel; and
- one or more lift handles attached to the lateral extension;
- wherein the one or more lift handles are configured to be used to lift a patient disposed on the mattress body.

8. The inflatable patient handling mattress of claim 7, wherein the mattress body further comprises a perimeter band between the top panel and the bottom panel.

9. The inflatable patient handling mattress of claim 7, wherein the lateral extension comprises a non-woven polyester material.

10. The inflatable patient handling mattress of claim 7, wherein the one or more lift handles each include a plurality of grip locations.

11. The inflatable patient handling mattress of claim 7, wherein the lateral extension defines a width from the first side of the mattress body to an outer edge of the lateral extension, and wherein the width is between about 3 inches and about 6 inches.

12. A method, comprising:

positioning a patient on an inflatable patient handling mattress, the inflatable patient handling mattress comprising:

a mattress body including:

a top panel;

a bottom panel; and a plenum chamber between the top panel and the bottom panel configured to be filled with air;

a first lateral extension extending from a first side of the mattress body;

a second lateral extension extending from a second side of the mattress body, the second side opposite the first side, wherein the first lateral extension and the second lateral extension are portions of a single sheet of material positioned between the top panel and the bottom panel, wherein the single sheet of material defines a window corresponding to the plenum chamber between the top panel and the bottom panel; and one or more lift handles attached to the first lateral extension; and lifting upward on at least one of the one or more lift handles to lift the patient.

13. The method of claim 12, wherein the inflatable patient handling mattress further includes one or more lift handles attached to the second lateral extension.

14. The method of claim 13, wherein the lifting step includes lifting upward on at least one of the one or more lift handles attached to the second extension.

15. The method of claim 12, wherein the first lateral extension and the second lateral extension comprise a non-woven polyester material.

16. The method of claim 12, wherein the one or more lift handles each include a plurality of grip locations, and wherein the method includes gripping one of the plurality of grip locations.

* * * * *